United States Patent [19]

Hotchkiss, Jr.

[11] 4,310,094

[45] Jan. 12, 1982

[54] TOOL RACK

[76] Inventor: John E. Hotchkiss, Jr., 451 Cedar Hill Dr., San Rafael, Calif. 94903

[21] Appl. No.: 66,068

[22] Filed: Aug. 13, 1979

[51] Int. Cl.[3] ..... A47F 5/08

[52] U.S. Cl. ..... 211/60 T; 211/89

[58] Field of Search ..... 211/60 R, 60 T, 89, 211/69.8; 312/DIG. 33; 248/68 R, 37.6

[56] References Cited

U.S. PATENT DOCUMENTS

| | | | |
|---|---|---|---|
| 2,041,749 | 5/1936 | Fischer | 211/60 T X |
| 2,541,597 | 2/1951 | Midling | 211/60 T X |
| 3,077,977 | 2/1963 | Wood | 211/60 T UX |
| 3,305,100 | 2/1967 | Barbee | 211/60 T |
| 3,537,595 | 11/1970 | Mathisen | 211/60 R |
| 4,132,381 | 1/1979 | McClellan | 211/60 R X |

*Primary Examiner*—Roy D. Frazier
*Assistant Examiner*—Robert W. Gibson, Jr.
*Attorney, Agent, or Firm*—Manfred M. Warren; Robert B. Chickering; Glen R. Grunewald

[57] ABSTRACT

A tool rack providing a pair of transversely spaced tool receiving recesses defined by transversely aligned tool supporting walls; a spring mounted between the walls in position for engagement by a tool inserted in the recesses with the spring positioned to engage a midportion of the tool between the walls and to be resiliently deflected away from the walls to resiliently hold the tool in a three-point support. The walls are preferably inclined to the direction of resilient deflection of the spring and in the direction of increasing the spring deflection upon removal of the tool from the recess.

5 Claims, 3 Drawing Figures

TOOL RACK

BACKGROUND OF THE INVENTION

1. Field of Invention

The invention relates to racks adapted for positioning at work areas for demountably supporting small hand tools for convenient and ready access.

2. Description of Prior Art

The inventor is familiar with the following prior art which constitutes the most pertinent art known to him: U.S. Pat. Nos. 1,765,496; 2,068,308; 2,119,217; 3,095,092; 3,305,100; 3,702,136; and 3,837,477. These prior patents show tool racks of a nature only generally similar to that herein shown, lacking specific features of advantage referred to in the Abstract and hereinafter further described and claimed.

SUMMARY OF THE INVENTION

The tool holder of the present invention comprises a rack which may be conveniently mounted over a workbench, on a cabinet door, or the like, for securely and demountably holding for ready access a plurality of types of hand tools such as wrenches, pliers, screwdrivers, shears, etc. The rack comprises a box-like structure which may be conveniently and inexpensively manufactured from sheet metal or plastic and which has opposed parallel side walls formed with a plurality of slots, with the slots on one side wall transversely aligned with the slots on the opposite side wall so as to provide a double socket for receiving any elongated tool such as an open-ended or box wrench or screwdriver or the like which spans the two slots. Spring members are mounted interiorly of the box-like structure and in position to press a tool against the side walls. The latter are preferably inclined in a manner cofunctioning with the lateral thrust of the spring members to hold tools securely in place with a three-point support.

An object of the present invention is to provide a tool rack of the character described which is designed to support a multiplicity of frequently used hand tools in an attractive compact display within ready reach of the user for easy and rapid removal and replacement of individual tools.

Another object of the present invention is to provide a tool rack of the character above which is composed of a minimum number of sturdily formed parts functioning to provide a very long useful life and being of a design adapted for mass production of high quality units at modest cost.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
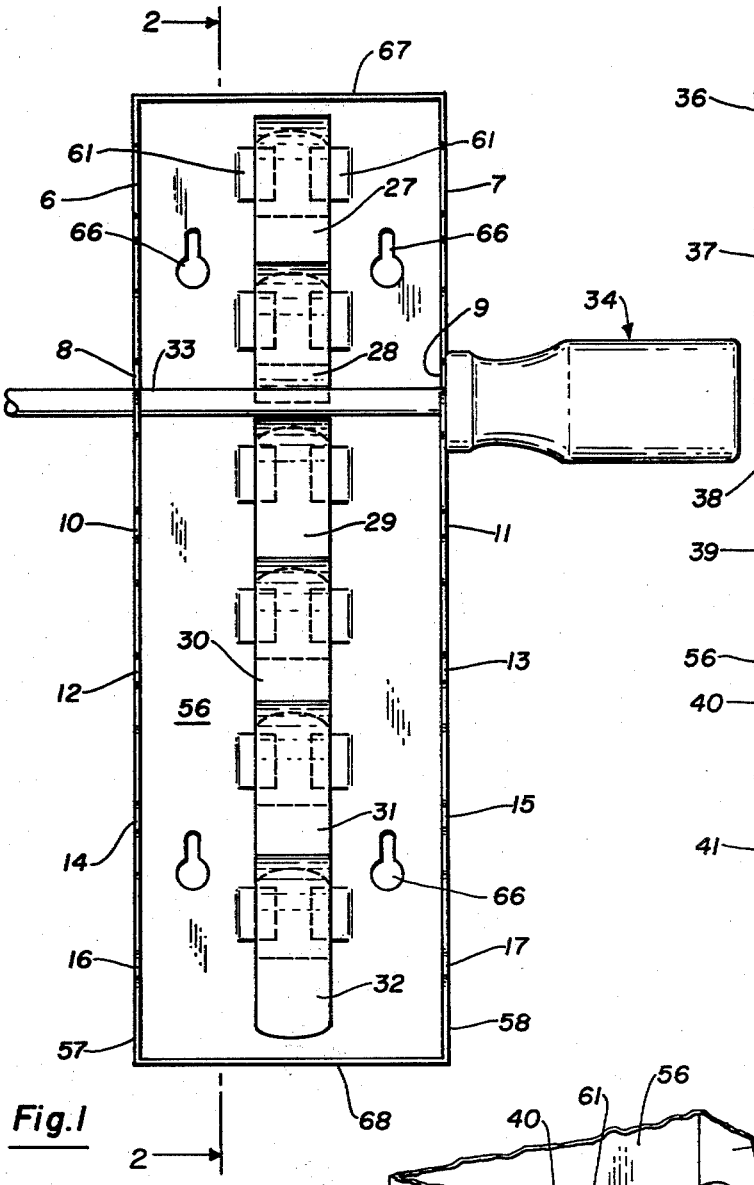
FIG. 1 is a front elevational view of a tool rack constructed in accordance with the present invention.
Figure 2:
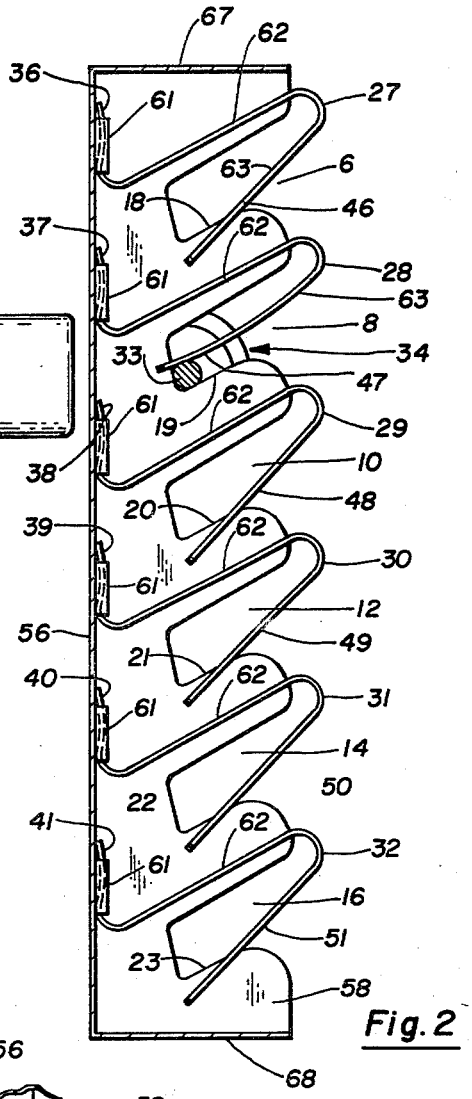
FIG. 2 is a cross sectional view of the rack taken substantially on the plane of line 2—2 of FIG. 1.
Figure 3:
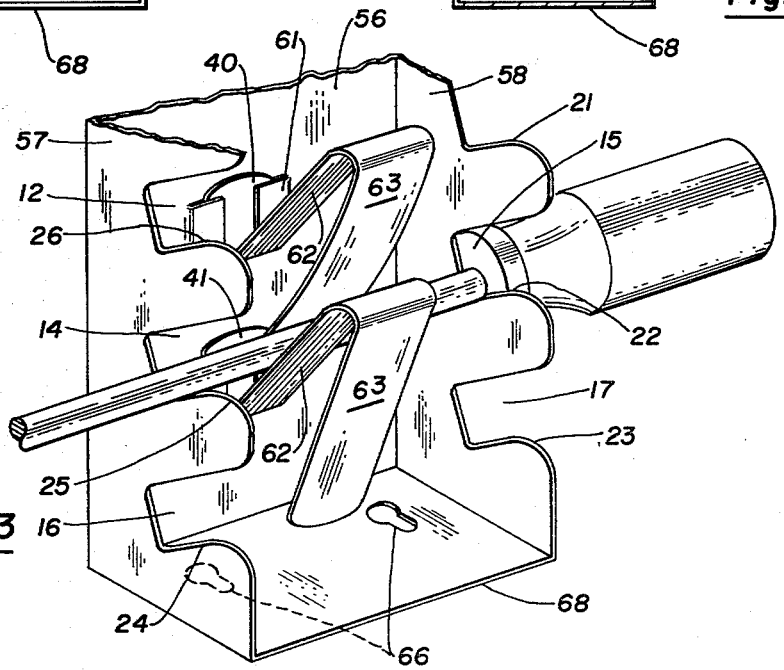
FIG. 3 is a fragmentary perspective view of a portion of the rack.

With reference to the accompanying drawing, the tool rack of the present invention is of elongated form and comprises, briefly, a plurality of pairs of transversely aligned and transversely spaced tool receiving recesses 6 and 7, 8 and 9, 10 and 11, 12 and 13, 14 and 15, and 16 and 17, each laterally opposed pair of recesses having transversely aligned and transversely spaced tool supporting walls, see walls 18–26 in FIGS. 2 and 3; a plurality of springs 27–32 mounted between the opposed pairs of walls 18–26 in position to be engaged by a tool, such as the blade 33 of a screwdriver 34 on insertion thereof into opposed recesses such as recesses 14 and 15 in FIG. 3, in spanning relation to and for support on walls 21 and 25; the springs being positioned to engage a midportion of the tool between the recess walls and to be resiliently deflected by the tool away from the walls upon such insertion to resiliently urge the tool against the walls in a three-point support. Preferably, the walls are all at the sides of the recesses spaced toward one end 68 of the rack and are inclined exteriorly toward the opposite end 67 of the rack and to the direction of resilient deflection of the springs in the direction of increasing the spring deflection upon removal of the tool from the recesses so as to cofunction with the springs to lock the tool in place.

As will be best seen from FIG. 3, each pair of transversely opposed recess walls 18–26 are positioned in transversely extending planes. The springs here each comprise a leaf spring having a resiliently deflectable leg supported at an exterior end 36–41, see FIG. 2, and having an opposite free deflectible end 46 extending in undeflected position into intersecting relation to the transverse plane connecting each pair of opposed walls 18–26 so as to form a V-shaped tool entryway, see FIG. 2. Preferably the exterior ends of the tool supporting walls are rounded to guide tool movement into the entryways.

As will be observed from the drawings, the tool mounting means here comprises a box-like member having a base or back wall 56 and spaced apart side walls 57 and 58, having transverse dimensions extending exteriorly and interiorly of the rack and being formed to provide recesses 6–17, opening exteriorly of the rack, and the tool supporting walls 18–26. Conveniently, spring ends 36–41 are secured to base 56 in medially spaced relation between sides 57 and 58. As here shown, tongues 61 are struck up from base 56 to overly and secure spring ends 36–41, the latter being bent generally perpendicularly from the contiguous spring leg. As a feature of the present construction, each spring is formed of inverted U-shape having one leg 62 terminating in the secured spring ends 36–41 and a second leg 63 providing the free deflectible end portions 46–51. Accordingly, the entire spring length is able to resiliently flex over the opposed leg portions as well as about the secured spring ends 36–41. Particularly, the springs may be formed to bow over their free leg portions 46–51 upon the insertion of a tool 33 as best seen in FIGS. 2 and 3, the bow being convex on the side of the tool thus improving the resilient holding action of the springs against the tools inserted in the receiving recesses.

One of the important features of the present tool rack is its universality in accepting a multiplicity of commonly used hand tools such as screwdrivers, wrenches (Allen, Crescent, monkey, open-ended and box types), pliers, shears, punches, and chisels having a dimension fitting within the recesses and a length spanning the supporting walls. Any of these tools of proper dimension may be easily and quickly snapped into seated, mounted position in the rack and with equal speed and facility removed therefrom. The design lends itself to being blanked and stamped out of sheet metal to afford relatively inexpensive mass production of high quality units at modest cost. Appropriate openings 66 may be provided in the base wall 56 and end walls 67 and 68 for most convenient mounting of the rack on normally vertical and horizontal surfaces typically found around a workbench as on cabinets, doors, etc.

What is claimed is:

1. A tool holder having spaced apart side walls having normally disposed front edges and formed with aligned tool receiving recesses opening to said front edges and dimensioned for receipt of a tool therein, said recesses having walls for support of a tool thereon in spanning relation to said side walls; and a U-shaped spring comprising opposed elongated legs, a U-shaped connecting portion, and opposite leg ends mounted medially between said side walls with said legs having a normal front and rear position, said opposite end of said rear leg being secured to said holder for free-standing support and resilient displacement of said legs, said front leg being juxtaposed to the plane of said recess walls for engagement of a mid-portion of said tool on insertion thereof into said recesses and to be resiliently deflected by said tool away from said plane to thereby resiliently urge said tool against said recess wall in a three-point support.

2. The device of claim 1, said recess walls being inclined in a rear to front direction providing a dimensional component co-functioning with said front leg to retain said tool within said recesses.

3. The device of claim 2, said side walls being elongated and formed with a plurality of said recesses in longitudinally spaced relation thereon;

a back wall connecting said side walls; and a plurality of said springs, one associated with each aligned pair of recesses and each having its rear leg end secured to said back wall medially of said side walls for mounting each spring in free-standing relation to its associated pair of recesses.

4. A device of claim 3, each of said front legs in undeflected position traversing said adjacent plane of the associated recess walls rearwardly of the forward ends of said walls thereby forming V-shaped tool entryways between said front spring legs and recess walls.

5. The device of claim 4, the forward ends of said recess walls being rounded to guide tool movement into said entryways.

* * * * *